United States Patent [19]

Mizuno et al.

[11] 4,264,885

[45] Apr. 28, 1981

[54] ELECTROMAGNETIC RELAY

[75] Inventors: Shigeo Mizuno, Nagoya; Shigeo Hara, Aichi; Kaneyasu Arakawa; Minoru Kondo, both of Nagoya, all of Japan

[73] Assignee: Kabushiki Kaisha Tokai Rika Deuki Seisakusho, Aichi, Japan

[21] Appl. No.: 22,364

[22] Filed: Mar. 20, 1979

[30] Foreign Application Priority Data

Mar. 31, 1978 [JP] Japan ..... 53-40887[U]

[51] Int. Cl.[3] ..... H01H 63/04

[52] U.S. Cl. ..... 335/135; 335/128

[58] Field of Search ..... 335/135, 128

[56] References Cited

U.S. PATENT DOCUMENTS 3,156,799 11/1964 Depner ..... 335/135

3,501,720 3/1970 Mathys ..... 335/135

3,750,060 7/1973 Pfenning ..... 335/135

*Primary Examiner*—Harold Broome

*Attorney, Agent, or Firm*—Wenderoth, Lind & Ponack

[57] ABSTRACT

An electromagnetic relay which is so arranged that a plate spring having a movable contact and a fixed contact plate having a fixed contact are secured to a stopper member fixed to a heel piece for the electromagnet, with a lift pin of the plate spring being adapted to contact the moving iron, so that the pressure at the contacts and the gap between the contacts as well as the lowest working voltage are readily adjusted as desired by merely transforming the stopper member. Furthermore, since the movable contact is free from positional deviation, mutual erosion or cutting between the contacts due to uneveness of the contact surfaces arising from sparks and the like has been eliminated for positive closing or opening of the contacts.

6 Claims, 9 Drawing Figures

ELECTROMAGNETIC RELAY

BACKGROUND OF THE INVENTION

The present invention relates to a relay and more particularly, to an electromagnetic relay for use in electrical and electronic equipment.

Electromagnetic relays are commonly employed extensively in various electric and electronic appliances for energizing or deenergizing sections of electric systems of the electrical and electronic appliances under normal or abnormal conditions.

Conventionally, the electromagnetic relay of the above described kind generally includes a moving iron or movable iron piece arranged to be attracted by an electromagnet, a plate spring attached to the moving iron, and a travelling or movable contact fixed to the plate spring for selective contact with or spacing from a fixed or stationary contact.

The known electromagnet relay having a construction as described above, however, has problems related to durability of constituent members, since it is necessary, for example, to bend the plate spring or to extend or lengthen a coil spring for returning the moving iron to adjust pressure at the contacts, to adjust the gap between the contacts or to adjust the lowest working voltage for actuating said electromagnetic relay. Moreover, since there exist side play to a certain extent at a hinge portion through which the moving iron is pivotally connected to a heel piece or yoke of the electromagnetic relay, surfaces of the contacts tend to be made uneven due to sparks arising from opening and closing of the contacts, resulting in such problems as when the movable contact is undesirably stuck to the fixed contact, thus not being properly spaced from the latter during the opening of the contacts.

SUMMARY OF THE INVENTION

Accordingly, an essential object of the present invention is to provide an electromagnetic relay for use in electrical and electronic equipment which can be readily adjusted not only for the pressure at the contacts and the gap between the contacts irrespective of the moving iron, but can be adjusted for the lowest working voltage thereof as well.

Another important object of the present invention is to provide an electromagnetic relay of the above described type in which positional side play during contact of the movable contact and fixed contact is eliminated to avoid undesirable adhesion or locking therebetween.

A further object of the present invention is to provide an electromagnetic relay of the above described type which is accurate and stable in functioning and operates with a high reliability.

A still further object of the present invention is to provide an electromagnetic relay of the above described type which is simple in construction, and can be manufactured at a low cost.

In accomplishing these and other objects, according to one preferred embodiment of the present invention, the electromagnetic relay for use in electrical and electronic equipment includes an electromagnet having an electromagnetic coil and an iron core, a heel piece coupled to said electromagnet, a moving iron pivotally connected to said heel piece for selective contact with and spacing from said iron core according to energization and deenergization of said electromagnet, a spring member connected between said moving iron and heel piece for normally urging said moving iron in a direction spaced from said iron core during deenergization of said electromagnet; the relay further comprises a stopper member secured to the heel piece, a plate spring member having a movable contact and fixed to the stopper member, a lift pin member secured to the plate spring member for contact with the moving iron, and a fixed contact plate member secured to the stopper member so as to be electrically insulated from the latter and having a fixed contact member in a position corresponding to the movable contact member of the plate spring member. By the arrangement of the present invention as described above, it has been made possible to readily adjust the pressure at the contacts and the gap between the contacts as well as to readily adjust the lowest working voltage for the electromagnetic relay by merely transforming the shape of the stopper member; the movable contact free from positional deviation has advantageously eliminated the mutual erosion between the movable and fixed contacts due to rough contact surfaces resulting from sparks and the like during functioning of the electromagnetic relay.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
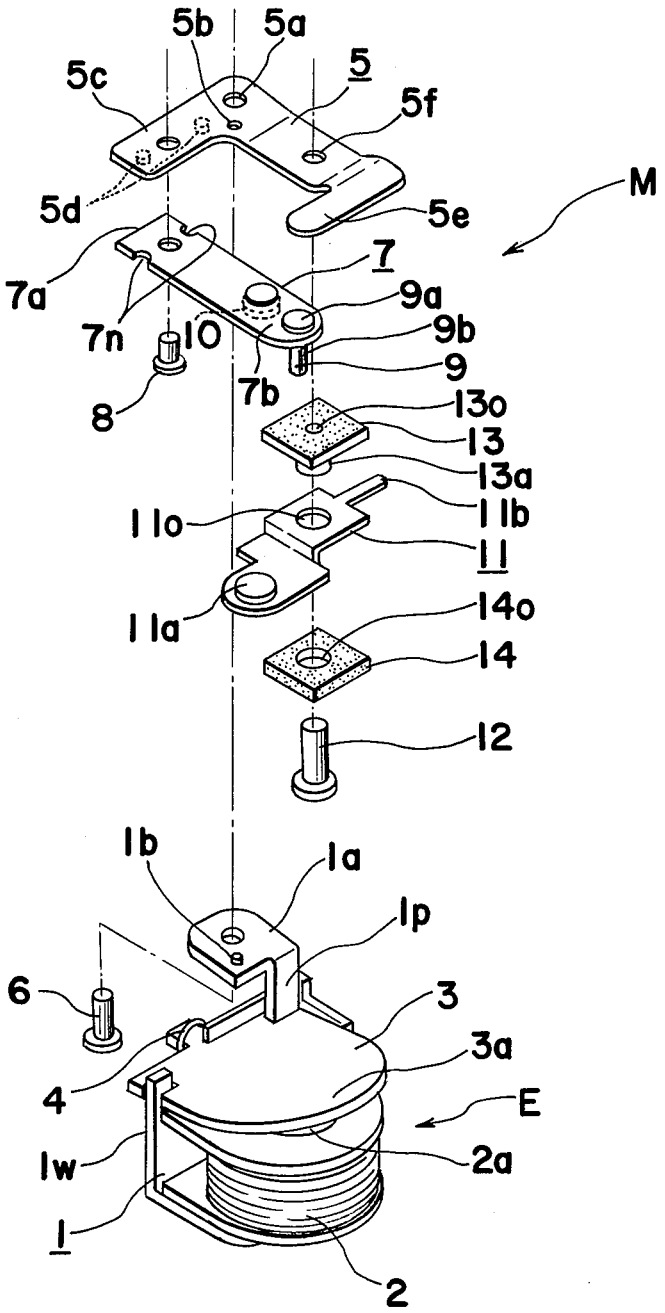
FIG. 1 is an exploded view of an electromagnetic relay according to one preferred embodiment of the present invention.

Referring now to the drawings, there is shown in FIGS. 1 to 6 an electromagnetic relay according to one preferred embodiment of the present invention. In FIG. 1, the electromagnetic relay M generally includes an electromagnet E having an electromagnetic coil 2 and an iron core 2*a*, a heel piece or yoke 1 coupled to the electromagnet E, a moving iron or movable iron piece 3 pivotally connected at its one end to the heel piece 1, a spring member 4 connected between the moving iron 3 and the heel piece 1 for urging the moving iron 3 in a direction away from the iron core 2, all of which are arranged in a known manner, a stopper member 5 of approximately U-shaped configuration, a plate spring 7 secured at its one end 7*a*, to corresponding one end 5*c* of the stopper member 5 for example, by a rivet 8, a movable contact 10 having a contact surface 10*a* at its under surface (FIG. 3) and fixed to the plate spring 7, for example, by riveting, staking and the like, and a fixed contact plate 11 having a fixed or stationary contact 11*a* provided thereon in a position corresponding to the contact surface 10*a* of said movable contact 10.

Figure 3:
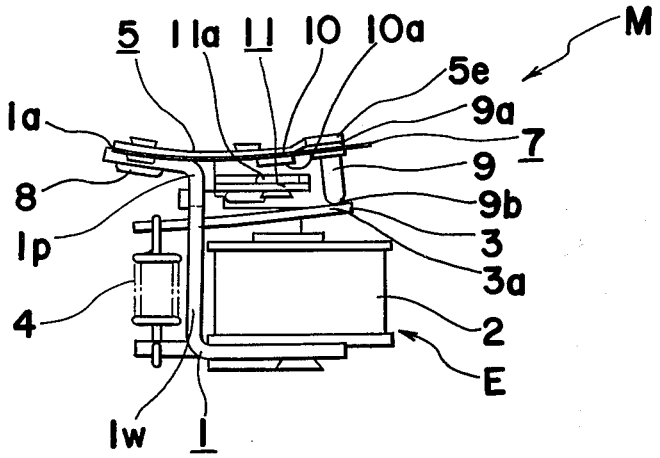
FIG. 3 is a side elevational view of the electromagnetic relay of FIG. 2.
Figure 4:
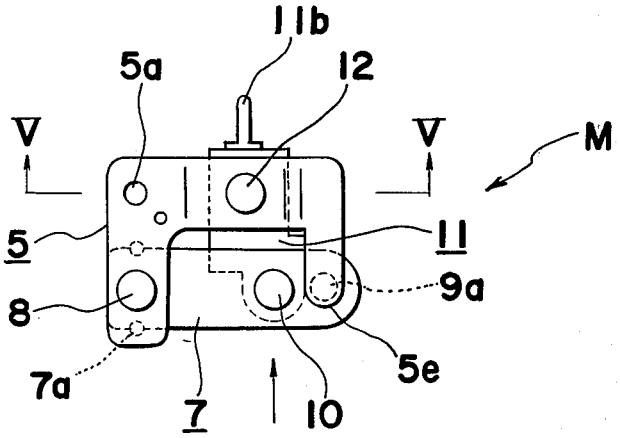
FIG. 4 is a view similar to FIG. 2, which particularly shows arrangements of constituent members, with the electromagnet of FIG. 2 removed for clarity.

More specifically, the stopper member 5 is secured for example, by a rivet 6 at its one corner portion 5*a*, to the upper surface 1*a* of a fixing post 1*p* extending upwardly from a rear wall 1*w* of the heel piece 1 and bent rearwardly with a suitable inclination as is seen from FIG. 3. In the above state, since a projection 1*b* provided on the surface 1*a* of the fixing post 1*p* is fitted into a small opening 5*b* formed in the stopper member 5 in a position adjacent to the corner 5*a* thereof, the stopper member 5 is rigidly fixed to the fixing post 1*p* of the heel piece 1. The plate spring 7 fixed at its one end 7*a*, to the end 5*c* of the stopper member 5, for example, by the rivet 8 as described earlier is provided, at the other end 7*b* thereof corresponding in position to the under surface of the other end 5*e* of the stopper member 5, with a lift pin 9 which is fixed to the end 7*b*, for example, by staking to provide a head portion 9*a* projecting a certain extend from the upper surface of the plate spring 7 and a lower portion 9*b* extending downwardly from the under surface of the end 7*b* as shown. Since the plate spring 7 has a pair of notches 7*n* formed in opposite edges adjacent to the end 7*a* thereof and respectively received by corresponding projections 5*d* provided at the under surface of the end 5*c* of the stopper member 5, it is positively fixed to the stopper member 5. The fixed contact plate 11 is fixed to the under surface of the stopper member 5 in a position deviated toward the end 5*e* from the central portion of said under surface so as to be electrically insulated from the stopper member 5, and the fixed contact 11*a* provided on the upper surface of one end of the fixed contact plate 11*a* corresponds in position to the contact surface 10*a* of the movable contact 10 fixed to the end 7*b* of the spring plate 7.

Figure 5:
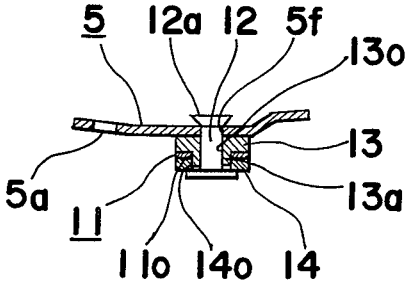
FIG. 5 is a cross sectional view taken along the line V—V of FIG. 4.
Figure 6:
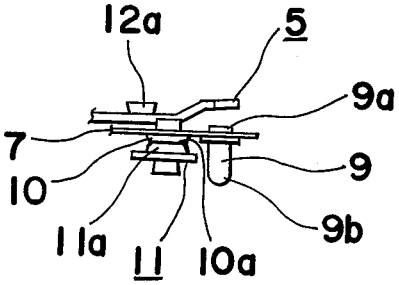
FIG. 6 is a fragmentary side view of the electromagnetic relay as observed in the direction of an arrow in FIG. 4.

Subsequently, the fixing of the fixed contact plate 11 to the stopper member 5 will be described in detail hereinbelow with reference also to FIGS. 5 and 6.

Figure 2:
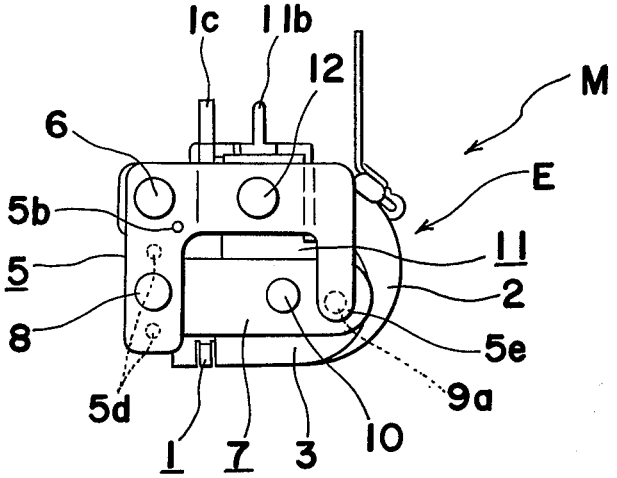
FIG. 2 is a top plan view of the electromagnetic relay of FIG. 1 in an assembled state.

Firstly, a cylindrical portion 13*a* extending outwardly from one surface of a first spacer 13 having a square plate-like shape with a central opening $\mathbf{13}_0$ and made, for example, of insulating material such as rubber and the like is inserted into an opening $\mathbf{11}_0$ formed in the central portion of the fixed contact plate 11. Simultaneously, a second spacer 14 of similar shape and material to the first spacer 13 and having a central opening $\mathbf{14}_0$ formed therein is fitted into the cylindrical portion 13*a* of the spacer 13 extended through the opening $\mathbf{11}_0$ of the fixed contact plate 11, and then, a rivet 12 is inserted from the under surface of the second spacer 14 through the openings $\mathbf{14}_0$, $\mathbf{11}_0$, $\mathbf{13}_0$ into an opening 5*f* formed in the stopper member 5 so as to be staked or caulked as at 12*a* for fixing. The fixed contact plate 11 is further provided with a projection 11*b* at its other end for connection of an external lead wire (not shown) thereat, while the heel piece 1 is also formed with a projection 1*c* extending outwardly therefrom for connection of a lead wire as shown in FIG. 2.

By the above arrangement, during deenergization of the electromagnet E, since the plate spring 7 is biased toward the moving iron 3, with the spring force of the plate spring 7 being set to be smaller than that of the spring 4, the end 7*b* of the spring plate 7 is in contact with the under surface of the corresponding end 5*e* of the stopper member 5 through the head portion 9*a* of the lift pin 9. Accordingly, in the state as described above, the contact surface 10*a* of the movable contact 10 provided on the plate spring 7 is spaced from the corresponding surface of the fixed contact 11*a* of the fixed contact plate 11 (FIG. 3).

In the above state, upon energization of the electromagnet E, the moving iron 3 is attracted to the iron core 2*a* against the urging force of the spring 4, and therefore, the spring plate 7 is inclined downwardly by the spring force thereof together with the lift pin 9 until the lift pin 9 contacts the forward end 3*a* of the moving iron 3. Accordingly, the movable contact 10 is brought into contact with the fixed contact 11*a*, with consequent shortcircuiting between the lead wire connecting terminals 1*c* and 11*b*.

In the foregoing embodiment, control and adjustment of the contact pressure between the movable contact 10 and the fixed contact 11*b* and adjustment of the gap between the contacts 10 and 11*b* can be effected by transformation of the shape of the stopper member 5, i.e. by altering its angle of inclination, while the lowest working voltage required for attraction of the moving iron 3 may also be adjusted through alterations of the angle of inclination of the stopper member 5 and depressing force to be exerted on the moving iron 3 through the lift pin 9.

It should be noted here that the lift pin 9 described as fixed to the end 7*b* of the plate spring 7 in the foregoing embodiment may be modified to be integrally formed with or fixed to the moving iron 3 so as to extend upwardly from the forward end 3*a* of the moving iron 3 for contact with the corresponding end 7*b* of the spring plate 7. In the above case also, the function of the electromagnetic relay is generally similar to that described with reference to FIGS. 1 through 6, and therefore, detailed description thereof is abbreviated for brevity.

It should also be noted that in the foregoing embodiment, although the present invention is mainly described with reference to the electromagnetic relay M of two contact type, the concept of the invention is not limited in its application to such electromagnetic relay of two contact type alone, but may readily be applicable, for example, to an electromagnetic relay of three contact type as described hereinbelow with reference to FIGS. 7 to 9.

Figure 7:
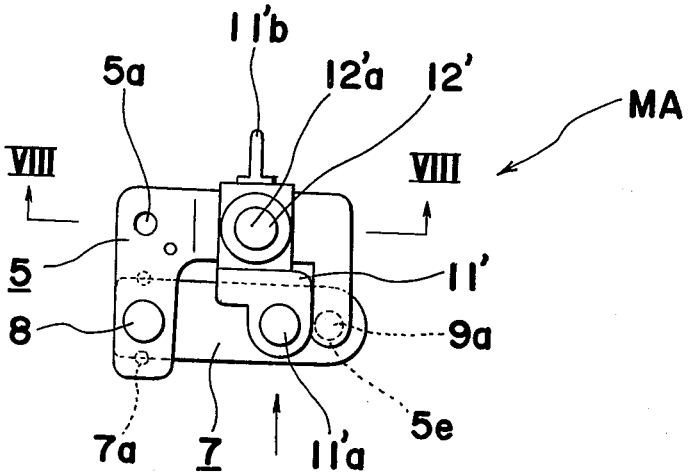
FIG. 7 is a view similar to FIG. 4, which particularly shows a modification thereof.
Figure 8:
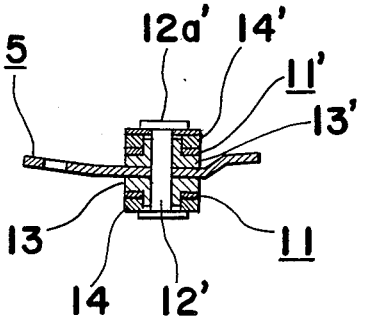
FIG. 8 is a cross sectional view taken along the line VIII—VIII of FIG. 7.
Figure 9:
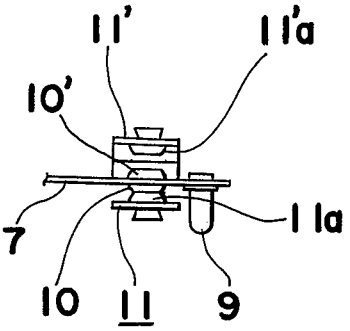
FIG. 9 is a fragmentary side view of the electromagnetic relay as observed in the direction of an arrow in FIG. 7.

Referring to FIGS. 7 to 9, there is shown a modification of the electromagnetic relay M of FIGS. 1 through 6. In the modified electromagnetic relay MA of FIGS. 7 to 9, another set of elements including the spacer 13', fixed contact plate 11' and spacer 14' is further provided on the upper surface of the stopper member 5 in a position corresponding to the set of elements including the spacer 13, fixed contact plate 11 and spacer 14, with the stopper member 5 being held therebetween as is most clearly seen from FIG. 8, so as to be secured thereat by the rivet 12' extending therethrough and suitably staked as at 12*a'*. Meanwhile, another movable contact 10' is provided on the upper surface of the spring plate 7 in a position corresponding to the movable contact 10 provided on the under surface thereof so that the movable contacts 10 and 10' of the plate spring 7 are positioned between the fixed contacts 11*a* and 11*a'* of the fixed contact plates 11 and 11' so as to confront the latter as shown in FIG. 9. By this arrangement, a normally open switch contact and a normally closed switch contact are advantageously constituted for the electromagnetic relay MA, and if a plurality of the electromagnetic relays MA are connected in parallel, an electromagnetic relay of multi-circuit three contact type may be available.

As is clear from the foregoing description, in the electromagnetic relay according to the present invention, since it is so arranged that the plate spring having the movable contact and the fixed contact plate having the fixed contact are secured to the stopper member fixed to the heel piece, with the lift pin of the plate spring being adapted to contact the moving iron, the pressure at the contacts and the gap between the contacts as well as the lowest working voltage are readily adjusted as desired by merely transforming the shape of the stopper member. Furthermore, since the movable contact is free from positional deviation, mutual erosion or cutting between the contacts due to uneveness of the contact surfaces arising from sparks and the like has been advantageously eliminated for positive closing or opening of the contacts.

Although the present invention has been fully described by way of example with reference to the accompanying drawings, it is to be noted that various changes and modifications are apparent to those skilled in the art. Therefore, unless such changes and modifications should otherwise depart from the scope of the present invention, they should be construed as included therein.

What is claimed is:

1. In an electromagnetic relay including an electromagnet having an electromagnetic coil and an iron core, a heel piece mechanically coupled to said electromagnet, a moving iron pivotally connected to said heel piece for selective contact with and spacing from said iron core respectively in accordance with the energization and deenergization of said electromagnet, a spring member mechanically connected between said moving iron and said heel piece for providing a force between said moving iron and said heel piece to urge said moving iron in a direction spaced from said iron core, the improvement comprising:

a stopper member secured to said heel piece;

a plate spring member having movable contact means, said plate spring member affixed to said stopper member;

a lift pin member provided between said plate spring member and said moving iron for associated movement therebetween;

a fixed contact plate member affixed to said stopper member and electrically insulated therefrom, said fixed contact plate member having fixed contact means provided in a position corresponding to the position of said movable contact means of said plate spring member;

wherein when said coil is deenergized, said moving iron transmits a force from said spring member through said lift pin member to said plate spring member, thereby deflecting said plate spring member to contact said stopper member, wherein said fixed contact means is spaced apart from said movable contact means; and wherein when said coil is energized, said plate spring member applies a force to said movable contact means to contact said fixed contact means and wherein said moving iron is spaced apart from said lift pin member, wherein the force between said fixed contact means and said movable contact means is independent of said spring member force.

2. An electromagnetic relay as in claim 1, wherein said lift pin is secured to said spring plate member to extend outwardly therefrom toward said moving iron.

3. An electromagnetic relay as in claim 1, wherein said lift pin is secured to said moving iron so as to extend outwardly therefrom toward said spring plate member.

4. An electromagnetic relay as in claim 1, wherein said spring force of said spring plate member is set to be smaller than said spring force of said spring member.

5. An electromagnetic relay as in claim 1, wherein said movable contact means comprises a movable contact provided on one surface of said plate spring member and wherein said fixed contact means comprises a fixed contact provided on one surface of said fixed contact plate member.

6. An electromagnetic relay as in claim 1, further comprising another fixed contact plate member arranged such that said plate spring member is between said fixed contact plate member and said another fixed contact plate member;

wherein said movable contact means comprises a pair of movable contacts provided in corresponding positions on opposite surfaces of said plate spring member and wherein said fixed contact means comprises a pair of fixed contacts respectively provided on respective surfaces of said fixed contact plate member and said another fixed contact plate member, said pair of fixed contacts and said pair of movable contacts arranged such that an electrical connection is made between said plate spring member and said fixed contact plate when said coil is energized and an electrical connection is made between said plate spring member and said another said fixed contact plate member when said coil is deenergized.

* * * * *